US011476105B2

(12) United States Patent
Newsome et al.

(10) Patent No.: US 11,476,105 B2
(45) Date of Patent: Oct. 18, 2022

(54) CONCENTRIC PERMEATION SYSTEM FOR TRANSFER OF NEUTRAL GASEOUS MATERIAL

(71) Applicant: The Government of the United States of America, as represented by the Secretary of the Navy, Arlington, VA (US)

(72) Inventors: Graham Asher Newsome, Riverdale, MD (US); Kevin John Johnson, Odenton, MD (US); Michael Paul Malito, Washington, DC (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/207,336

(22) Filed: Mar. 19, 2021

(65) Prior Publication Data

US 2021/0296107 A1 Sep. 23, 2021

Related U.S. Application Data

(60) Provisional application No. 62/991,658, filed on Mar. 19, 2020.

(51) Int. Cl.
*H01J 49/00* (2006.01)
*H01J 49/04* (2006.01)

(52) U.S. Cl.
CPC ..... *H01J 49/0422* (2013.01)

(58) Field of Classification Search
CPC ..... H01J 49/0422; H01J 49/049
USPC ..... 250/281, 282, 288
See application file for complete search history.

(56) References Cited

U.S. PATENT DOCUMENTS 3,788,545 A * 1/1974 Budd ..... B01F 3/022 239/34
4,531,398 A * 7/1985 Di Benedetto .... G01N 33/0006 73/1.04
4,883,958 A * 11/1989 Vestal ..... G01N 30/7273 250/288
5,294,378 A * 3/1994 Succi ..... G01N 33/0006 261/104
6,225,129 B1 * 5/2001 Liu ..... G01N 30/96 436/161
7,713,331 B2 * 5/2010 Gerner ..... B01D 19/0036 95/46
8,414,684 B2 * 4/2013 Liu ..... B01D 19/0031 95/46
2010/0223979 A1 * 9/2010 Ploehn ..... G01N 15/0826 73/38
2013/0082172 A1 * 4/2013 Syage ..... H01J 49/14 250/288
2016/0033456 A1 * 2/2016 Lyman ..... G01N 33/0045 250/282
2016/0133449 A1 * 5/2016 Burton ..... G01N 27/622 250/288

* cited by examiner

*Primary Examiner* — Michael Maskell
(74) *Attorney, Agent, or Firm* — US Naval Research Laboratory

(57) ABSTRACT

A method of transferring neutral gaseous material includes the steps of passing heated gas through flow tube in a central gas stream; and permeating a chemical dopant inward to the central gas stream through walls of the flow tube.

12 Claims, 2 Drawing Sheets

CONCENTRIC PERMEATION SYSTEM FOR TRANSFER OF NEUTRAL GASEOUS MATERIAL

RELATED APPLICATIONS

This application claims the benefit of U.S. Provisional Application No. 62/991,658 filed Mar. 19, 2020, which is hereby incorporated herein by reference.

FEDERALLY-SPONSORED RESEARCH AND DEVELOPMENT

The United States Government has ownership rights in this invention. Licensing inquiries may be directed to Office of Technology Transfer, U.S. Naval Research Laboratory, Code 1004, Washington, D.C. 20375, USA; +1.202.767.7230; techtran@nrl.navy.mil, referencing NC 112337.

FIELD OF INVENTION

The present invention relates generally to trace vapor generators, and more particularly to a miniaturized trace vapor generator.

BACKGROUND

Reliable generation of known-concentration chemical vapors is important in many scenarios, particularly in the field of analytical chemistry. For example, ambient ionization mass spectrometry has become an important analytical technique, as it allows non-destructive analysis of a wide variety of different types of objects and mixtures with limited to no sample preparation.

SUMMARY OF INVENTION

However, the conventional techniques are necessarily impacted by dynamic ambient conditions such as local variations in humidity at short and long time scales. The described invention would serve to alleviate these problems by stabilizing the chemistry of the ambient chemical environment at the ionization source, as well as by enabling the introduction of specific chemical dopants to predictably adjust and optimize the ionization process.

Normally, to introduce a dopant to a gas flow tube and mass spectrometry interface, a sample of liquid is placed near the tube inlet to evaporate, creating an unknown concentration of dopant in the local atmosphere. Such a configuration is fundamentally irreproducible, potentially exposes laboratory personnel to chemical vapor in an unsafe fashion, and is only effective with particularly volatile liquids. Positioning the output from a commercial gas generator near the ambient sampling system is more reproducible if not quantitative, but the additional gas flow may have a negative effect on sampling.

Alternatively, the output of a commercial trace gas generator can be connected to a container built around the experimental system. The container prevents exposure of the greater laboratory, and the dopant concentration is somewhat better defined by the generator output and the container volume. However, the container prevents easy "walk up" access to the sampling system that has become the norm for ambient mass spectrometry.

Therefore, presented is a method that adds dopant vapor to the system in a reproducible, measurable fashion without adding a diluent airflow to the sampling tube or physically impeding access to the sampling site.

Embodiments of the present invention may be used to transport a stream of sampled neutral, gas-phase molecules while simultaneously permeating a controllable amount of gaseous chemical dopant from a liquid reservoir to the sample stream. The object of the material transport may be to provide analyte vapor mixtures with controlled amounts of chemical dopants to an ambient ionization mass spectrometry system for subsequent chemical analysis.

According to one aspect of the invention, a method of transferring neutral gaseous material includes the steps of: passing heated gas through flow tube in a central gas stream; and permeating a chemical dopant inward to the central gas stream through walls of the flow tube.

Optionally, the method includes the step of adjusting one or more liners lining an interior wall of the flow tube to set the amount of permeable surface area in the tube.

Optionally, the method includes the steps of connecting an ambient ion source and a mass spectrometer; and transporting a neutral, gas-phase sample and a controllable amount of chemical dopant to be ionized and detected.

According to another aspect of the invention, a miniature trace gas generator includes an outer tubular housing; end fittings defining an inlet and an outlet of the miniature gas generator; a permeable tubing concentrically spaced within the tubular housing and defining with the tubular housing and the end fittings an annular reservoir for liquid therebetween.

Optionally, the miniature trace gas generator includes one or more inert-coated tube inserts longitudinally adjustable within the gas permeable tubing and configured to selectively control a surface area of the gas permeable tubing exposed to gas flowing from the inlet to the outlet.

The foregoing and other features of the invention are hereinafter described in greater detail with reference to the accompanying drawings.

DETAILED DESCRIPTION

Exemplary embodiments of the invention include a concentric permeation tube and gas transfer device that seals a refillable volume around the outer diameter of a length of polytetrafluoroethylene (PTFE) tubing, the inside of which is at atmospheric pressure.

Figure 1:
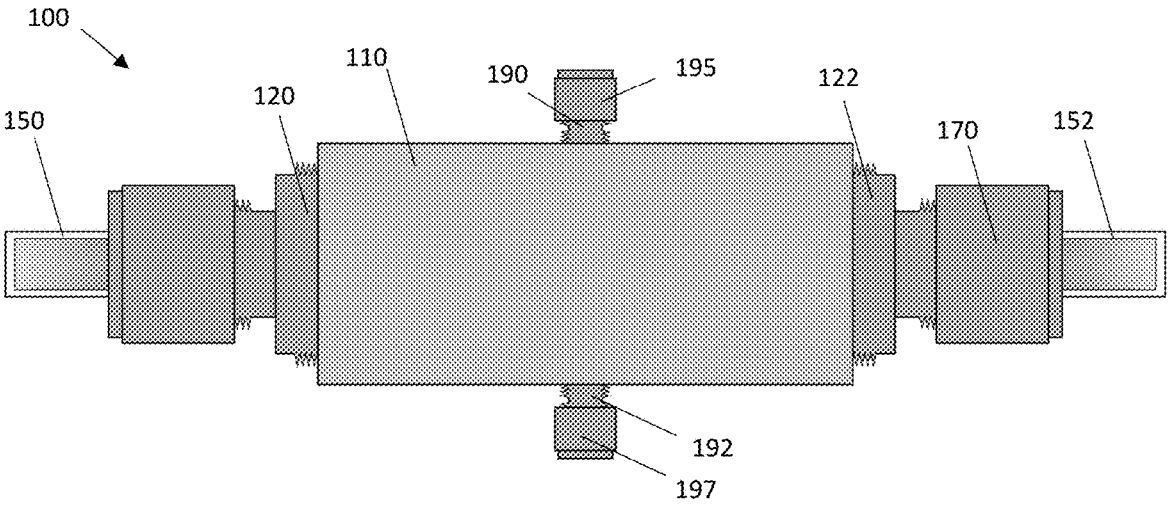
FIG. 1 shows an exemplary permeation tube.
Figure 2:
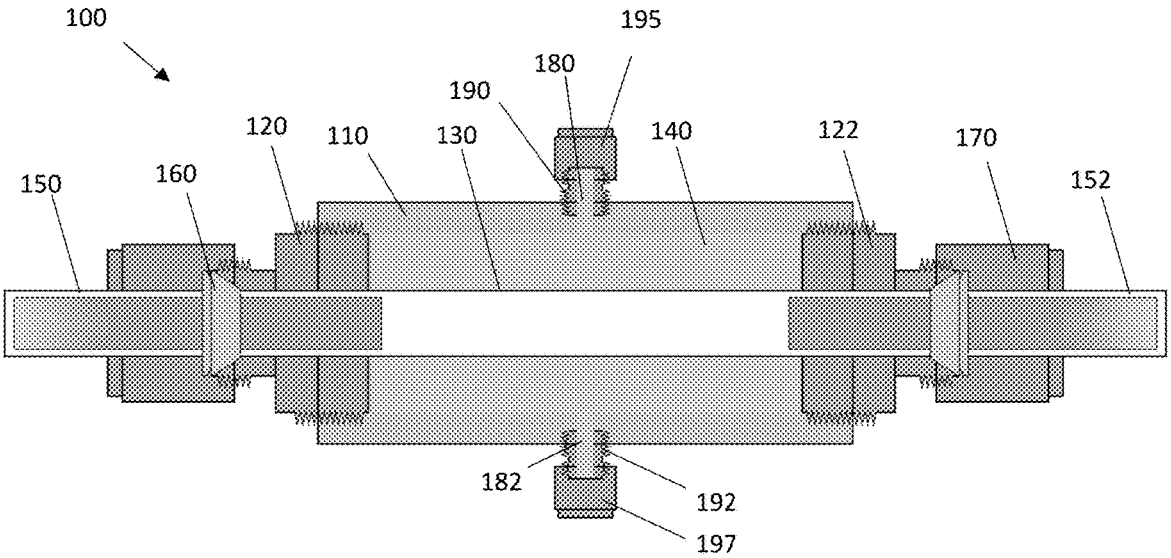
FIG. 2 shows a cross-sectional view of the exemplary permeation tube.

Referring to FIGS. 1 and 2, shown is an exemplary miniature trace gas generator 100. A hollow, cylindrical outer housing 110 has inner threads (e.g., national pipe thread standard (NPT) threads) on opposite ends, which hold end fittings 120, 122 which may be, for example, threaded-to-swaged fittings (e.g., NPT-to-Swagelok fittings). Permeable (for example PTFE) tubing 130 runs through the hollow space 140 which acts as a reservoir. Inert-coated (e.g., SilcoNert 2000-coated) stainless steel tubing lengths 150, 152 each with an outer diameter matched to the inner diameter of the PTFE tubing, are inserted into the PTFE tubing. The coated stainless steel tubes are inserted to a depth within the PTFE tubing to leave a central PTFE surface area uncovered by the stainless steel. The PTFE and coated stainless steel tubing inserts are secured by the compression of stainless steel ferrules 160 around the tubing and into the fittings on either end with nuts 170. The hollow space around the tubing is also sealed closed by the swage fittings. Some length of the PTFE and stainless steel tubing protrudes out from the swaged fittings to facilitate connections to other devices. The cylindrical housing also has threaded ports 180, 182 at two positions on its radial surface that lead to the hollow space. Each radial port holds a threaded-to-swaged fitting 190, 192 closed with a plug 195, 197. The radial fittings are unplugged to fill the hollow space with liquid and re-plugged.

Exemplary embodiments may be used in conjunction with other components to transport neutral, gas-phase analytes while permeating a controllable amount of gaseous chemical dopant from the liquid reservoir to the sample stream. The object of the material transport may be an ambient ionization mass spectrometry system.

Figure 3:
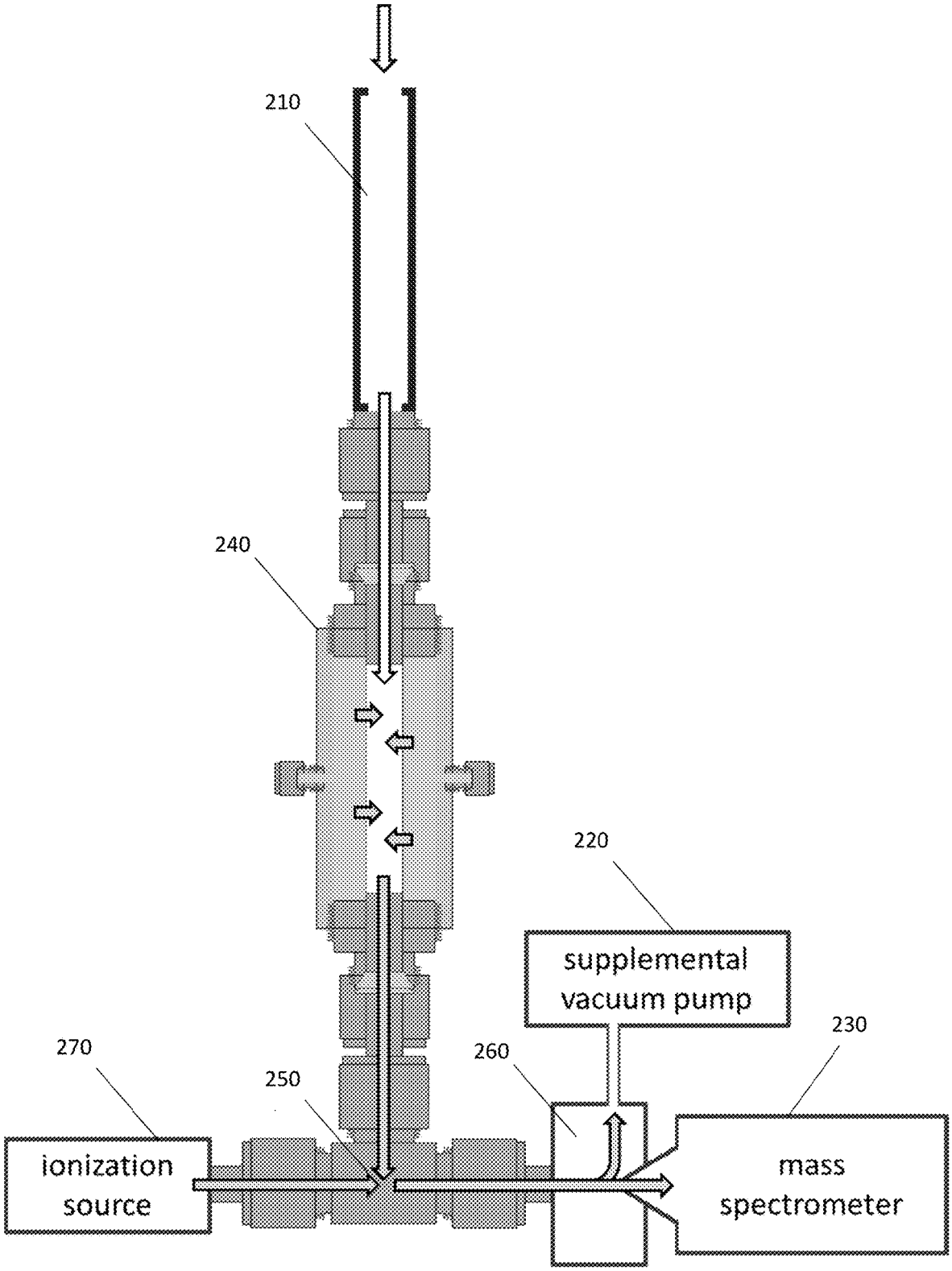
FIG. 3 shows an exemplary system incorporating the exemplary permeation tube.

Turning now to FIG. 3, carrier air and gas-phase analytes at atmospheric pressure enter the inlet to heated tubing 210 continuously pulled into the system by the vacuum of a supplemental vacuum pump 220 and/or a mass spectrometer 230. The air is heated during its transit through the heated tubing and enters the concentric permeation device 240 through a coated stainless steel tubing insert in PTFE tubing. The elevated air temperature within the exposed section of the PTFE tubing causes chemical from the liquid reservoir to permeate through the polymer surface area and enter the airstream flowing through the tubing. The coated stainless steel tubes limiting the PTFE surface area for permeation and prevent gas-phase analytes from adhering to PTFE surfaces inside the fittings away from the liquid reservoir. The chemical-doped airstream is pulled by the vacuum out of the concentric permeation tube and into the mixing tee 250. Energetic species such as ions, metastable atoms, and/or photons generated by/in the ionization source 270 are also pulled into the mixing tee by the vacuum. Neutral molecules from the ambient air, neutral dopant molecules from the concentric permeation device reservoir, and energetic species from the ionization source create analyte ions as they interact in the mixing tee and ion transfer interface 260. A portion of the carrier air and analyte ions enter the mass spectrometer, and a portion enter the supplemental vacuum pump if used.

For a fixed surface area of PTFE tubing, the concentration of permeated trace gas plateaus at a certain elevated temperature. Permeation rate may be controlled by inlet temperature, tubing liner position (exposed polymer surface area) and/or flow speed.

As a peripheral for ambient mass spectrometry: the present invention may be used for moving neutral gas-phase analytes from some atmospheric pressure origin to an ion source, in contrast to conventional methods for devices concerning the movement of gas-phase ions at atmospheric pressure from an ionization source to a mass spectrometer. No other gas transfer tube, for ions or neutral materials, is able to add a controlled amount of dopant to a gas stream like embodiments of the present invention without diluting the source gas.

As a standalone trace gas generator, unlike conventional designs for in-tube permeation, the surface area of the polymer membrane in embodiments of the present invention can be adjusted by remaking the tubing seal with a different length of coated stainless steel liner. No gas permeation tube on the market functions by having the source gas flow through the permeation unit.

It is important to note that one having skill in the art, upon reading and understanding this disclosure, would recognize that the particular descriptions herein are not exhaustive, and that many alternative versions of the invention can be made. Some non-exhaustive examples of variations are given herein. It is also noted that these variants may be made individually or in any non-contradicting combination.

Embodiments of the invention could be produced with a different liner over the inner surface of the polymer tubing or without a liner.

Embodiments of the invention could be produced with different set lengths of the liner over the polymer tubing that restrict the exposure of surface area.

Embodiments of the invention could be produced with a liner whose length can be adjusted without breaking the seal on the polymer tubing and reservoir volume.

A different material could be used to construct the permeation tubing.

A different material with or without coating could be used to construct the outer invention housing and inner surface of the reservoir.

Different overall lengths of embodiments of the invention could be produced that have different set lengths of permeation tubing and liquid reservoir volume.

Embodiments of the invention could be designed with a different tubing diameter or reservoir/housing diameter.

The fill and drain ports on the outer housing could be connected via tubing to a supplemental reservoir of liquid.

The fill and drain ports could be differently positioned on the outer housing, or removed to make the device non-refillable.

Different fitting types could be used to connect the polymer tubing to the outer housing and seal the liquid reservoir, and different fitting types could be used in access ports to the reservoir.

The outer diameter of the outer housing may have different shaping to accommodate holding with a device (such as a wrench) while tightening fittings.

A different heat source could be used to control the temperature of air flowing into the invention.

A positive gas pressure could be used to push air into the device instead of using a vacuum to pull air through the invention.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of transferring neutral gaseous material, the method comprising the steps of:

passing heated gas through a flow tube in a central gas stream;

permeating a chemical dopant inward to the central gas stream through walls of the flow tube; and adjusting one or more liners lining an interior wall of the flow tube to set an amount of permeable surface area in the flow tube.

2. The method of claim 1, further comprising the steps of:

connecting an ambient ion source and a mass spectrometer; and transporting a neutral, gas-phase sample and a controllable amount of chemical dopant to be ionized and detected.

3. A miniature trace gas generator comprising:

an outer tubular housing;

end fittings defining an inlet and an outlet of the miniature gas generator;

a gas permeable tubing concentrically spaced within the outer tubular housing and defining with the outer tubular housing and the end fittings an annular reservoir for liquid therebetween; and one or more inert-coated tube inserts longitudinally adjustable within the gas permeable tubing and configured to selectively control a surface area of the gas permeable tubing exposed to gas flowing from the inlet to the outlet.

4. The miniature trace gas generator of claim 3, wherein the gas permeable tubing comprises polytetrafluoroethylene.

5. The miniature trace gas generator of claim 3, wherein the one or more inert-coated tube inserts comprises stainless steel.

6. The miniature trace gas generator of claim 3, further comprising a port disposed on a radial surface of the outer tubular housing.

7. The miniature trace gas generator of claim 6, further comprising another port disposed at a different location on the radial surface of the outer tubular housing.

8. An apparatus, comprising:

a miniature trace gas generator that includes:

an outer tubular housing, end fittings defining an inlet and an outlet of the miniature gas generator, a gas permeable tubing concentrically spaced within the outer tubular housing and defining with the outer tubular housing and the end fittings an annular reservoir for liquid therebetween, and one or more inert-coated tube inserts longitudinally adjustable within the gas permeable tubing and configured to selectively control a surface area of the gas permeable tubing exposed to gas flowing from the inlet to the outlet; and a mass spectrometer configured to receive from the outlet of the miniature gas generator.

9. The apparatus of claim 8, wherein the gas permeable tubing comprises polytetrafluoroethylene.

10. The apparatus of claim 8, wherein the one or more inert-coated tube inserts comprises stainless steel.

11. The apparatus of claim 8, further comprising a port disposed on a radial surface of the outer tubular housing.

12. The apparatus of claim 11, further comprising another port disposed at a different location on the radial surface of the outer tubular housing.

* * * * *